US007455179B2

(12) United States Patent
Bringard et al.

(10) Patent No.: US 7,455,179 B2
(45) **Date of Patent: *Nov. 25, 2008**

(54) BULK SHIPPING BOX ASSEMBLY WITH DETACHABLE PALLET

(76) Inventors: Timothy L. Bringard, 27708 Southpointe Dr., Grosse Ile, MI (US) 48138; Eric J Oberliesen, 728 Lavender, Monroe, MI (US) 48162

( * ) Notice: Subject to any disclaimer, the term of this patent is extended or adjusted under 35 U.S.C. 154(b) by 0 days.

This patent is subject to a terminal disclaimer.

(21) Appl. No.: 11/588,870

(22) Filed: Oct. 27, 2006

(65) Prior Publication Data

US 2007/0158224 A1 Jul. 12, 2007

Related U.S. Application Data

(63) Continuation of application No. 10/899,186, filed on Jul. 26, 2004, now Pat. No. 7,128,209.

(60) Provisional application No. 60/490,198, filed on Jul. 25, 2003.

(51) Int. Cl.
*B65D 19/00* (2006.01)
*B65D 3/22* (2006.01)

(52) U.S. Cl. ..... 206/386; 206/600; 229/122.32; 229/918

(58) Field of Classification Search ..... 206/386, 206/599–600; 108/51.3, 56.1, 56.3; 229/918–919, 229/122.21, 122.24, 122.26, 122.32
See application file for complete search history.

(56) References Cited

U.S. PATENT DOCUMENTS

| | | | | |
|---|---|---|---|---|
| 2,729,383 | A | 1/1956 | King | |
| 2,939,620 | A | 6/1960 | Royce | |
| 3,608,813 | A | 9/1971 | Blasdell | |
| 3,708,861 | A | 1/1973 | Hickey | |
| 3,709,425 | A | 1/1973 | Stapp | |
| 3,850,362 | A | 11/1974 | Stollberg et al. | |
| 4,863,024 | A * | 9/1989 | Booth | 206/386 |
| 4,976,353 | A | 12/1990 | Halliday | |
| 5,484,380 | A | 1/1996 | Bevins | |
| 5,918,744 | A | 7/1999 | Bringard et al. | |
| 6,186,393 | B1 | 2/2001 | Tsamourgelis | |
| 6,296,119 | B1 | 10/2001 | Wells | |
| 6,364,200 | B1 | 4/2002 | Moss et al. | |
| 6,581,769 | B2 | 6/2003 | Nist | |
| 6,719,191 | B1 | 4/2004 | Christensen et al. | |
| 7,128,209 | B2 * | 10/2006 | Bringard et al. | 206/386 |
| 2003/0052038 | A1 | 3/2003 | Boersma | |

FOREIGN PATENT DOCUMENTS

| | | |
|---|---|---|
| GB | 2138391 | 10/1984 |

* cited by examiner

*Primary Examiner*—Bryon P Gehman
(74) *Attorney, Agent, or Firm*—Thomas W. Barnes, III; International Paper Company

(57) ABSTRACT

A shipping box (11), shipping box and pallet assembly (10), and a blank ($B_1$, $B_2$, $B_3$) for making the shipping box. The box has integral attaching tabs (38) projecting downwardly therefrom, with at least one slot (31, 32) therein for receiving an extended end (41) of at least one slat (40) on a pallet (13), to releasably attach the box to the pallet. A reinforcing insert (70) is placed in the box against opposite walls. The insert has a center panel (77) of the same width and height as the box wall against which it is placed, and double thickness end panels (78) at opposite sides of the center panel, extending perpendicular to the center panel and lying against adjacent box walls.

16 Claims, 18 Drawing Sheets

BULK SHIPPING BOX ASSEMBLY WITH DETACHABLE PALLET

This application claims the benefit of priority to U.S. Non-Provisional Patent Application having Ser. No. 10/899,186, filed Jul. 26, 2004, which claims the benefit of priority to U.S. Provisional Patent Application Ser. No. 60/490,198, filed Jul. 25, 2003, both of which are herein, incorporated in their entirety, by reference.

TECHNICAL FIELD

This invention relates to shipping containers for shipping products in bulk, and more particularly to a shipping box and detachable pallet for shipping relatively heavy and bulky items, such as automotive parts and the like.

BACKGROUND ART

Heavy duty boxes formed from one or more plies of corrugated cardboard are commonly used for shipping products in bulk. These boxes are frequently fastened to a pallet by staples or straps prior to filling the box with product. The end user must either have the container shipped to it in its set-up condition and already fastened on the pallet, or the end user must have the necessary stapling or strapping equipment available to set up the container in-house. In the former case, shipping the set-up container and pallet is expensive, and in the latter case, the assembly and set up requires added capital cost for equipment, is labor intensive, and presents safety issues for the end user and its employees. Also, because of the large size of a typical bulk box, it is difficult to reach into the box to apply staples. Moreover, the staples must penetrate both the box and the pallet, and strapping normally crushes the box. Both methods require hand tools to apply and remove the fasteners, and cause damage to both the box and the pallet, making re-use impractical.

Further, the boxes, with attached pallets, are commonly stacked on top of one another up to three pallets high. The side walls must have sufficient stacking strength to withstand the compressive load imposed on them. Conventional boxes of the type with which the present invention is concerned typically have a capacity of 500 pounds, i.e., they can safely be stacked three high when loaded with 500 pounds of product. However, some bulk products have greater weight than this, and although conventional boxes have a built-in safety factor, greater stacking strength is desirable.

Accordingly, there is need for a bulk shipping box and pallet assembly that can be manufactured and shipped to an end user in a knocked-down or flattened condition and then easily set up by the end user and fastened to a pallet, and easily detached from the pallet when desired, without requiring the use of hand tools or other equipment, and without causing damage to either the box or the pallet, whereby they are suitable for reuse. Further, there is need for a bulk shipping box having improved stacking strength.

DISCLOSURE OF THE INVENTION

The present invention comprises a bulk shipping box and blank for making the same, wherein the box has integral means for releasably attaching the box to a pallet without requiring the use of separate fasteners, and a shipping box and pallet assembly that can be manufactured and shipped to an end user in a knocked-down or flattened condition and then easily set up by the end user and fastened to a pallet, and detached from the pallet and knocked down to a flattened condition when desired, without requiring the use of hand tools or other equipment and without causing damage to either the box or the pallet. The box of the invention also incorporates a reinforcing insert that improves stacking strength.

As manufactured and shipped to the end user, the bulk shipping assembly of the invention comprises a box in a flattened tubular condition, a pallet, and a cover. The box includes integral slotted tabs that are engageable with the slats of the pallet to hold the box to the pallet without requiring the use of staples, strapping or other fasteners. The box can be quickly and easily erected by hand from the flattened condition to an open expanded condition, and then attached to the pallet by bending the slotted tabs and positioning the ends of a slat or slats of the pallet into the slots of the tabs to attach the box to the pallet. When it is desired to detach the box from the pallet and return it to its flattened condition, the tabs are flexed to disengage the pallet slats from the tab slots, and the box is unfolded to its flattened tubular condition. The box and pallet may then be reused, if desired.

More specifically, the box of the invention preferably is made from a single unitary blank of corrugated cardboard and has opposite side walls, opposite end walls, and bottom flaps that are foldable into closing relationship over the bottom of the box. Two opposed bottom flaps have die cuts in them defining attaching tabs that lie in the plane of the respective flap when the box is in its flattened condition, and that project downwardly from the bottom edge of the associated box side wall when the box is erected. The tabs include a first, outer panel that is a continuation of the associated side wall, and a second, inner panel that folds between the first panel and the pallet, forming a double thickness or double layer construction that is very strong and has sufficient rigidity to stay in locking engagement with the pallet slat during handling, and yet can be flexed and released from the pallet when desired. The tabs have one or more slots in at least the second, inner panel for receiving an extended end of at least one pallet slat when the box is erected and attached to the pallet.

In a first embodiment, a single slot is formed in each of the first and second panels of the attaching tabs, and when the second panel is folded inwardly of the first panel, the slots in the two panels are aligned for receiving the extended end of a pallet slat that forms part of the top deck of the pallet. This embodiment is designed for use with a pallet having only a few slats forming the top deck, with one of the slats lying on the centerline of the pallet, and the extended ends of that slat being engaged in the slots in both panels of the attaching tab.

In a second embodiment, two side-by-side slots are formed in each of the first and second panels for receiving the extended ends of two slats that form part of the top deck of the pallet. This embodiment is designed for use with pallets having a larger number of slats than in the first embodiment, wherein the two central slats lie on opposite sides of the pallet centerline, and extended ends of these two slats are engaged in the slots in both panels of the attaching tab.

In a third embodiment, there are no slots in the first or outer panel, and the extended ends of the pallet slat engage in a slot in only the second or inner panel of the attaching tab. The inner panel can have only one slot, as in the first embodiment, or two slots as in the second embodiment. In this regard, it should be understood that a number of slots other than one or two could be employed in each of the embodiments, if desired or necessary for a particular application.

According to another aspect of the invention, a reinforcing insert is placed in the box in each of at least two opposite ends or sides to increase the stacking capacity of the box. The reinforcing insert is made from a flat piece of corrugated cardboard having creases or scores at its opposite ends defining panels that are folded over and laminated together to form a double thickness flap at each of the opposite ends of the insert. A central portion of the insert between the flaps is approximately the same width as the side or end of the box, and when the insert is placed in the box the central portion lies against an inner surface of the side or end wall, and the two flaps lie against adjacent walls. The dimensions of the insert are such that it has a tight fit in the box and extends the full height and width of the wall against which it is placed. However, when it is desired to return the box to its flattened condition, the inserts can be removed. With the inserts, the stacking strength of the box is increased from about 500 pounds to about 850 pounds. Although the insert is shown and described herein as being used in a box having attaching tabs for securing the box to a pallet, it should be understood that the insert could be used with other types of boxes.

BRIEF DESCRIPTION OF DRAWINGS

The foregoing, as well as other objects and advantages of the invention, will become apparent from the following detailed description when taken in conjunction with the accompanying drawings, wherein like reference characters designate like parts throughout the several views, and wherein.

BEST MODES FOR CARRYING OUT THE INVENTION

Figure 1:
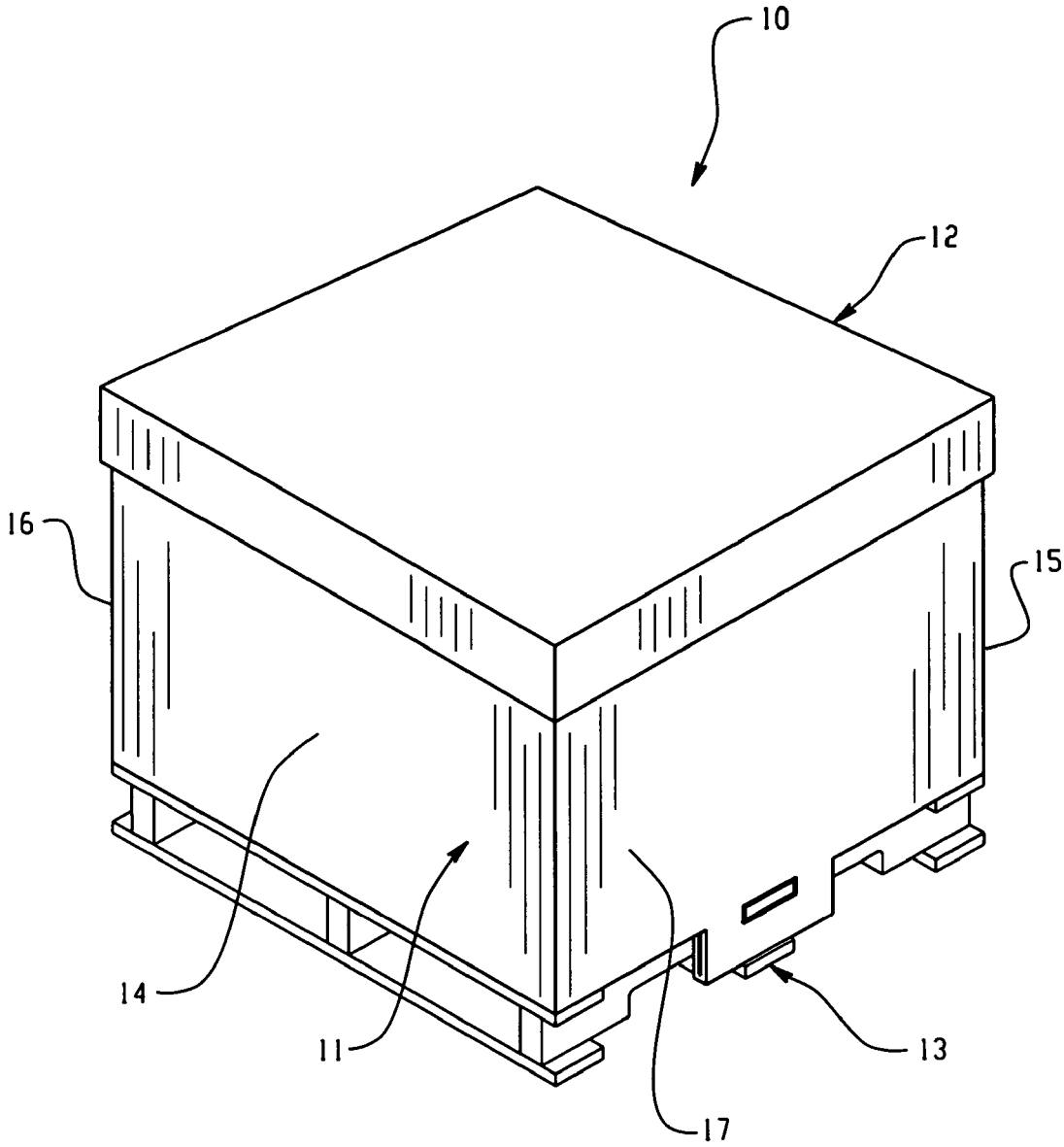
FIG. 1 is a top perspective view of a first embodiment of a box and pallet assembly according to the invention in fully set up condition.
Figure 2:
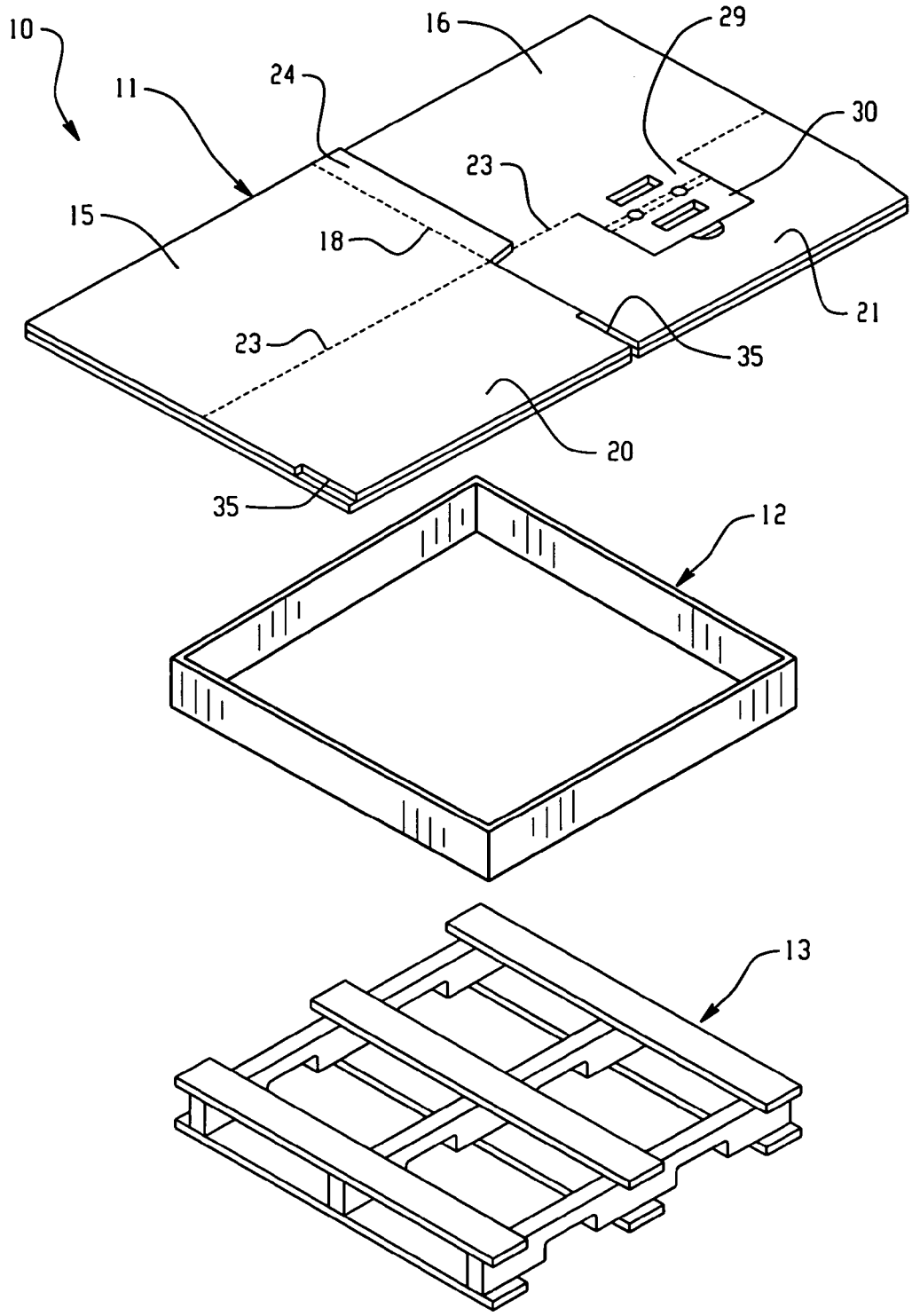
FIG. 2 is an exploded top perspective view of a box, pallet and cover assembly of the invention, as manufactured and shipped to an end user.

The bulk shipping assembly of the invention is indicated generally at 10, and as seen best in FIGS. 1 and 2, comprises a box 11, cover 12, and pallet 13. This is the assembly that typically would be manufactured and shipped to an end user in the disassembled, knocked-down flattened condition shown in FIG. 2.

Figure 16:
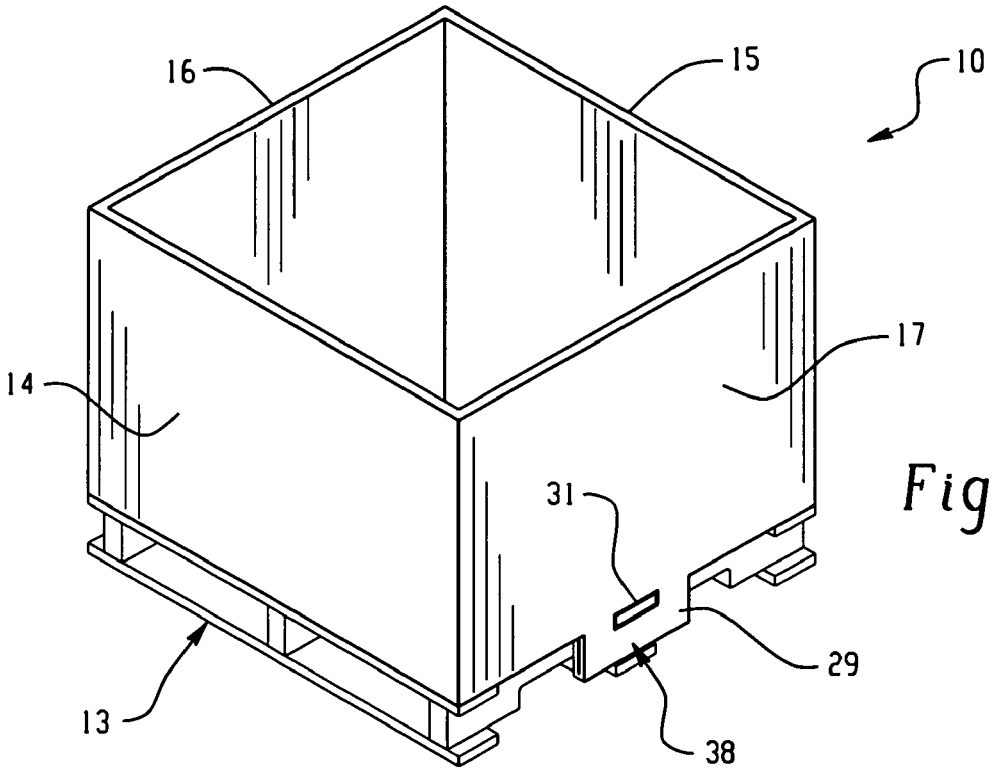
FIG. 16 is a top perspective view of the pallet and box assembly of FIG. 15, shown in an upright position.
Figure 17:
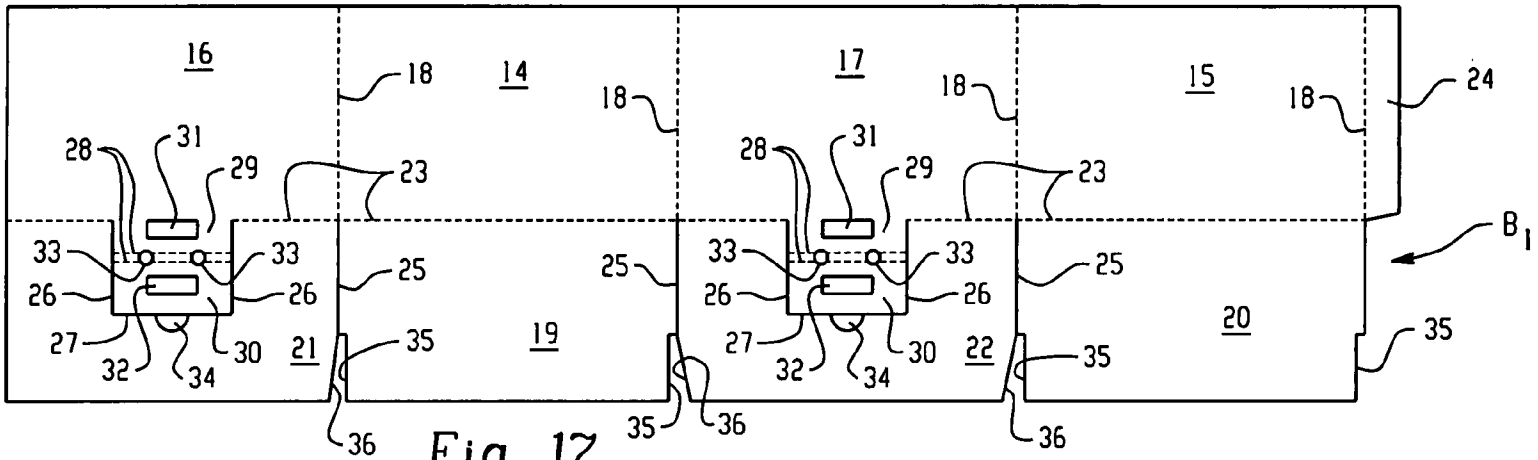
FIG. 17 is a plan view of a blank for making the box of FIGS. 1-16.
Figure 18:
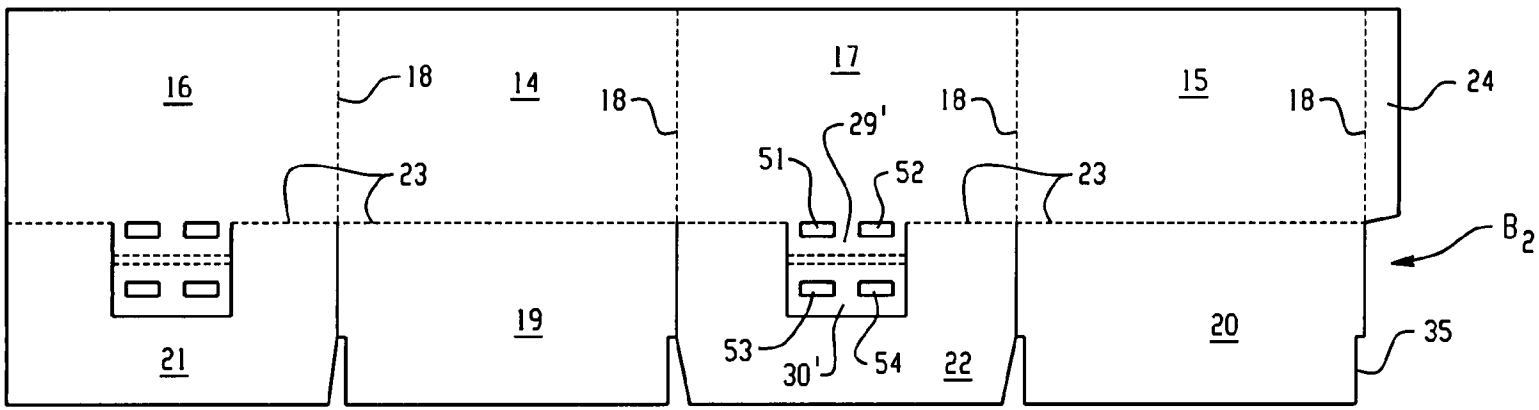
FIG. 18 is a plan view of a blank for making a box according to a second embodiment of the invention.
Figure 19:
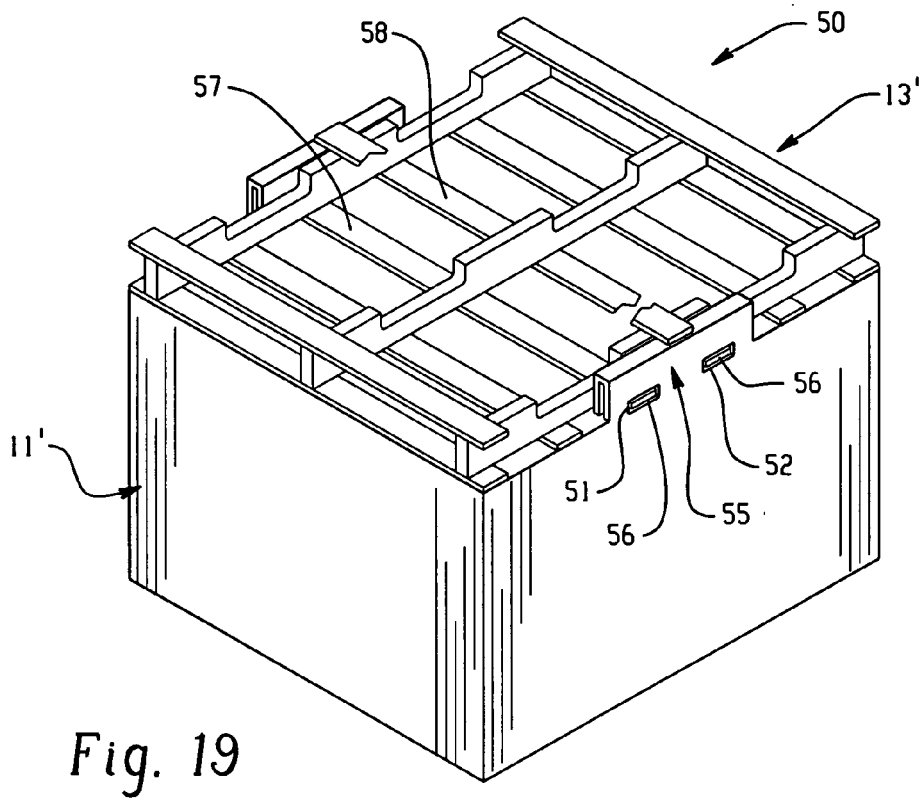
FIG. 19 is a bottom perspective view of a fully assembled box and pallet assembly according to the second embodiment of the invention.
Figure 20:
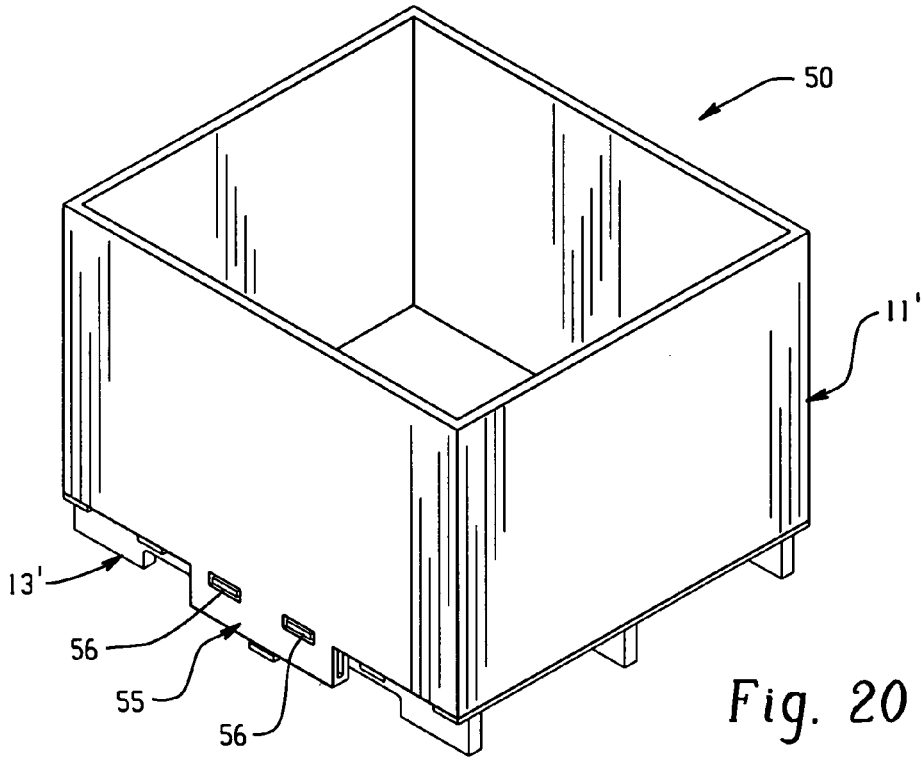
FIG. 20 is a top perspective view of the box and pallet assembly of FIG. 19, shown in an upright position.
Figure 21:
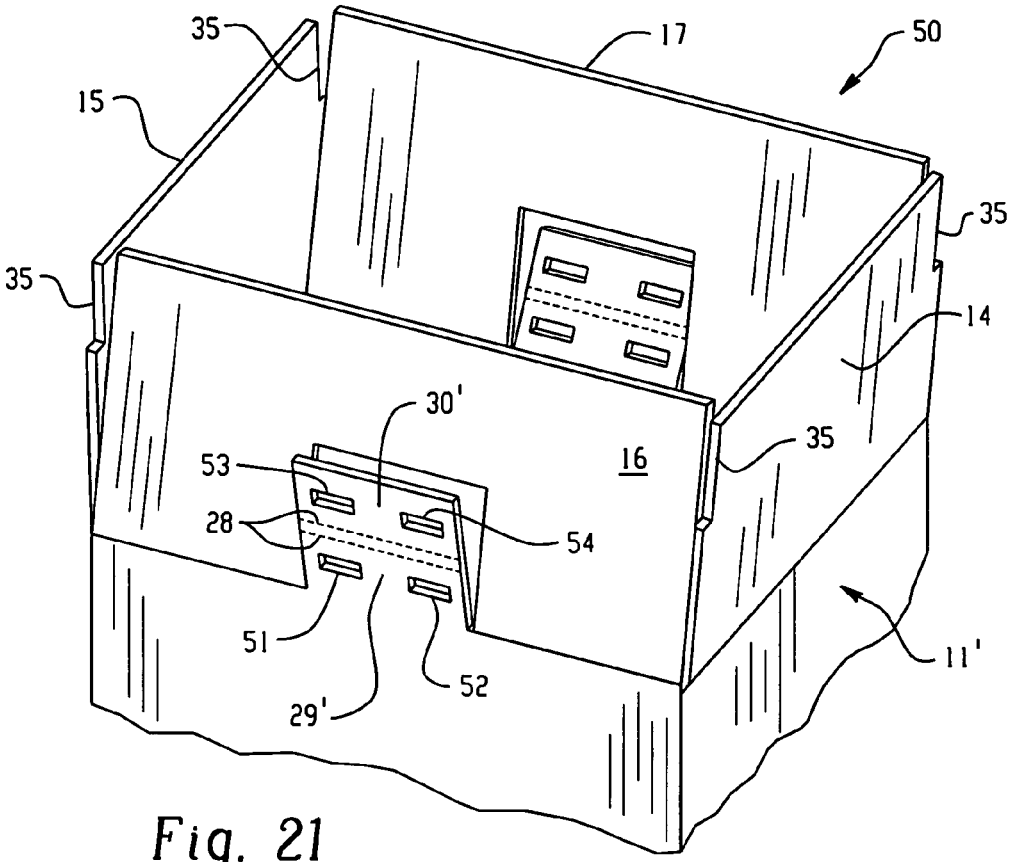
FIG. 21 is an enlarged fragmentary bottom perspective view of the box of FIGS. 18-20, showing the box in an expanded, upside down position prior to the bottom flaps being folded inwardly.
Figure 22:
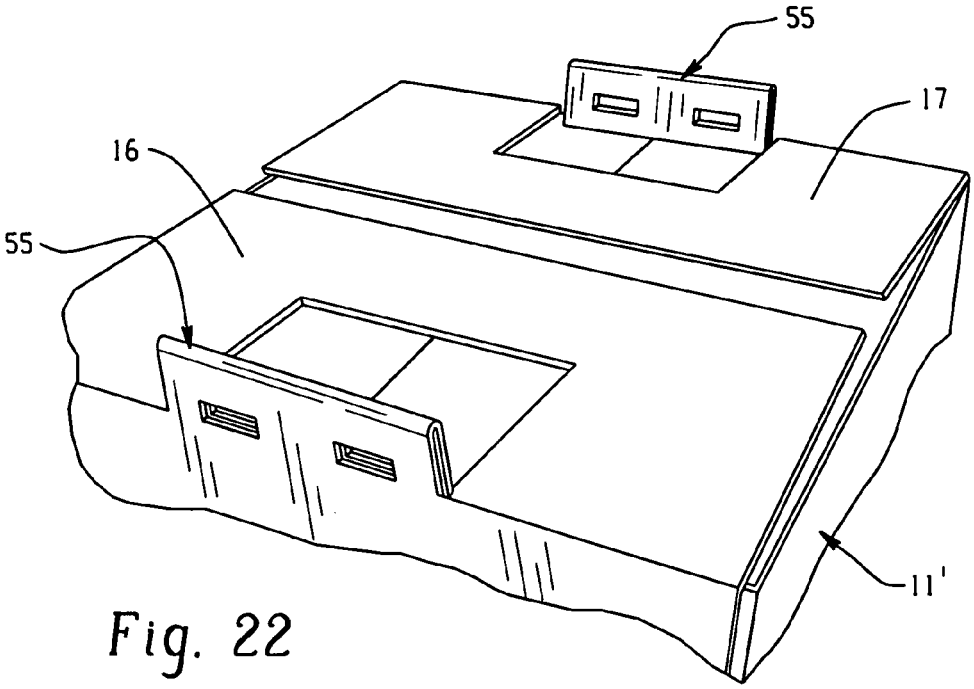
FIG. 22 is a fragmentary bottom perspective view of the box of FIG. 21, showing the bottom flaps in their inwardly folded position preparatory to attaching the pallet.
Figure 23:
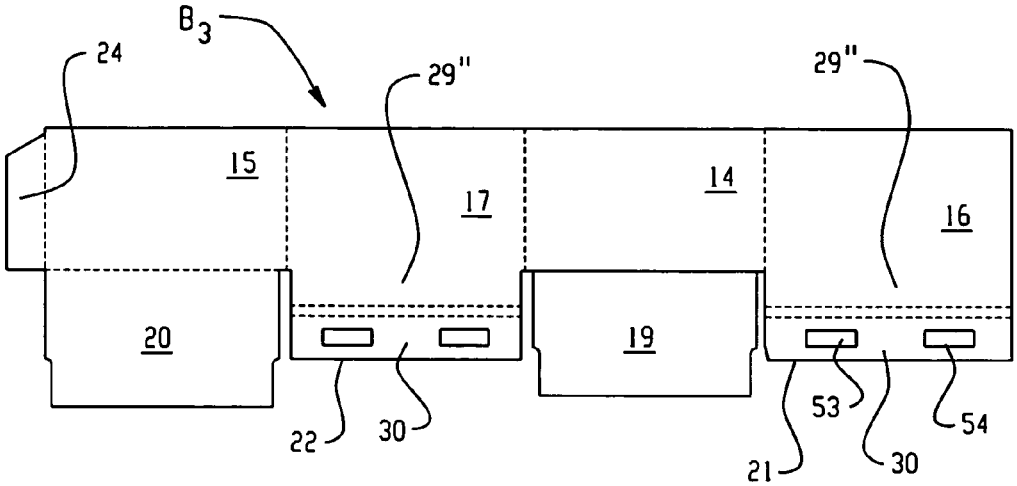
FIG. 23 is a plan view of a blank for making a third embodiment of a box according to the invention, wherein the first or outer panel of the attaching tab is devoid of slots for receiving extended ends of the pallet slats.
Figure 24:
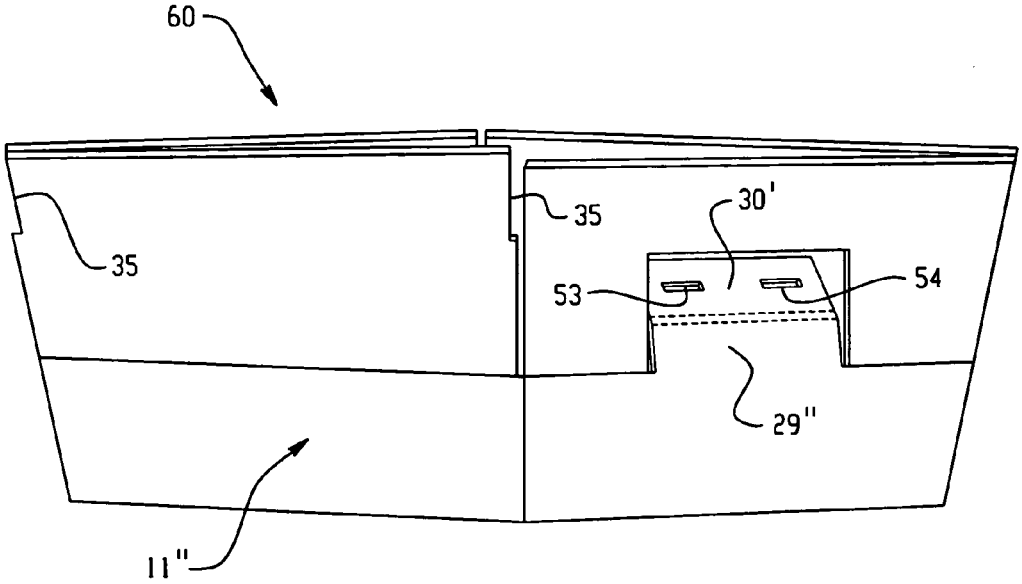
FIG. 24 is a side view in elevation of a box according to the third embodiment, shown upside down and in flattened condition as shipped to an end user.
Figure 25:
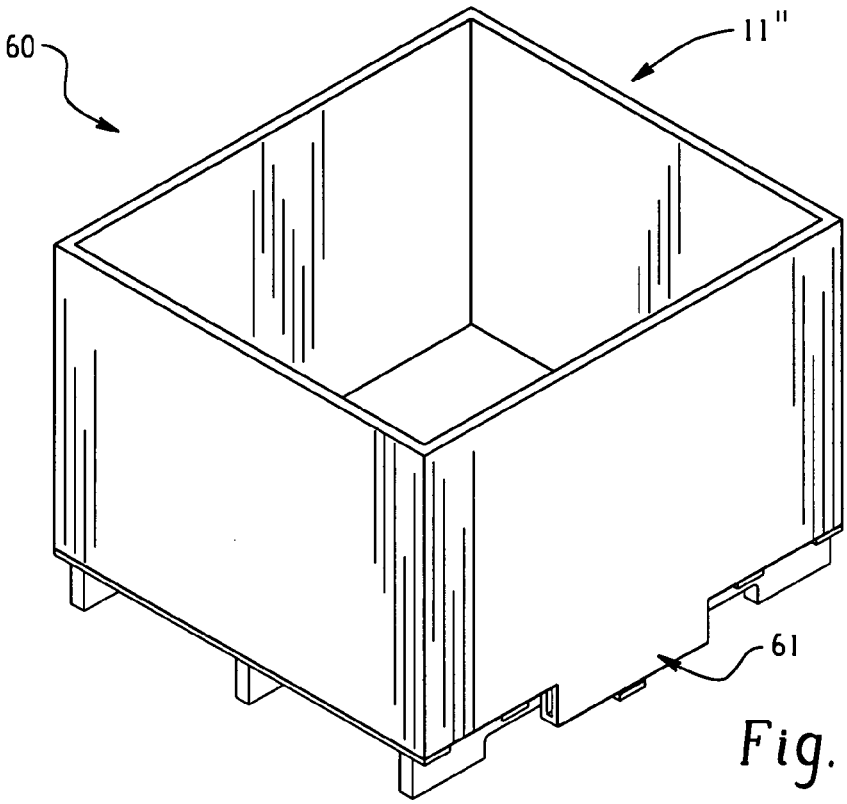
FIG. 25 is a top perspective view of a fully assembled pallet and box according to the third embodiment.
Figure 26:
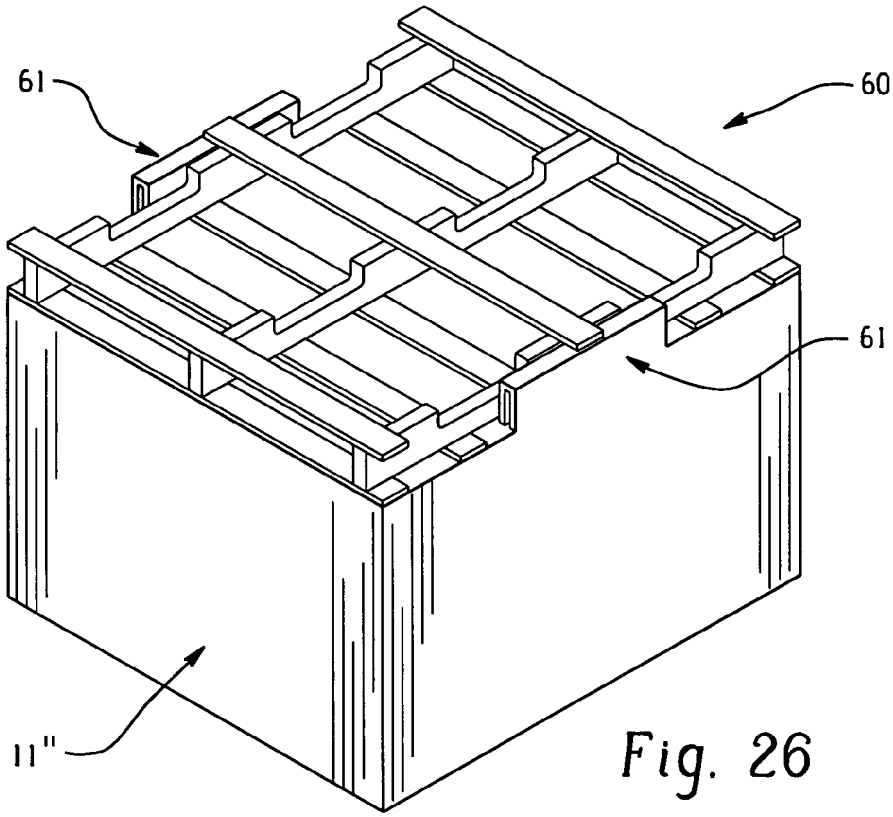
FIG. 26 is a fragmentary bottom perspective view of the pallet and box assembly of FIG. 25.
Figure 27:
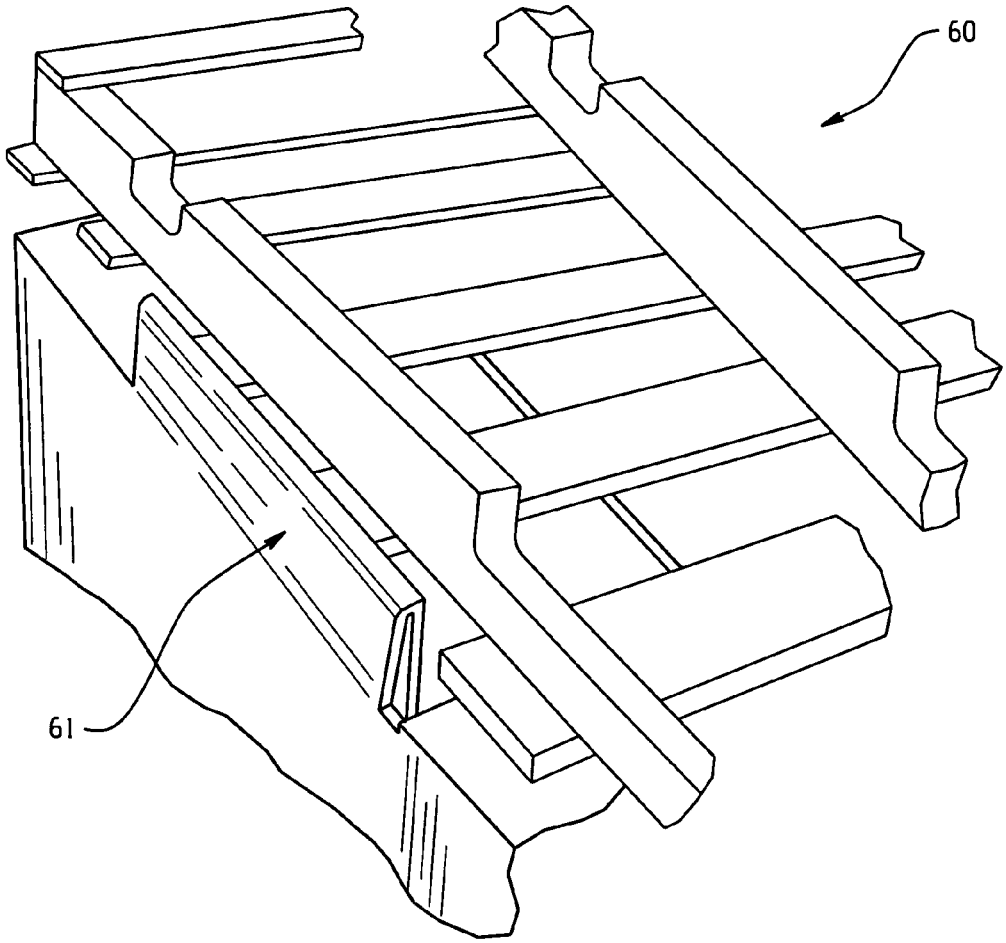
FIG. 27 is an enlarged fragmentary bottom perspective view of the pallet and box of FIG. 26, with the pallet just being positioned for engagement of the extended ends of the pallet slats in the slots in the inner panel of one of the attaching tabs.

In a first embodiment of the box of the invention, illustrated in FIGS. 1-17, the box 11 has two opposed side walls 14 and 15, and two opposed end walls 16 and 17. With particular reference to FIG. 17, which shows a blank $B_1$ for erecting the first embodiment, the side and end walls are foldably connected to one another along adjacent side edges at fold lines 18, preferably creased. Opposed major bottom flaps 19 and 20 and opposed minor bottom flaps 21 and 22 are foldably attached along fold lines 23, also preferably creased, to bottom edges of respective opposite side and end walls. A glue flap 24 is foldably connected to one side edge of one of the side walls for use by the manufacturer in gluing up the box prior to its shipment to the end user. The bottom flaps are separated from one another by cuts 25 extending in alignment with the respective fold lines 18.

A pair of parallel, spaced apart first cuts 26 are made in each of the minor bottom flaps 21 and 22, perpendicular to the fold lines 23 and extending approximately midway into the respective flap. Second cuts 27 extend between the ends of the cuts 26, spaced from the fold line 23, and a pair of closely spaced score lines 28 extend between the cuts 26 spaced between the fold line 23 and cut 27. The cuts and score lines define first and second rectangular panels 29 and 30. It will be noted that the fold line 23 does not extend across the area between the cuts 26 of each pair, whereby the first panel 29 extends rigidly from the bottom edge of the respective end wall. Second panel 30 is foldably joined to the first panel and has a greater width than first panel 29, whereby when the second panel is folded about the score lines 28 into overlying relationship with first panel 29, the second panel extends at its free edge past the fold line 23. The first panel has a rectangular slot 31 formed therein, with one edge of the slot lying in substantial alignment with the score line 23, and the second panel has a rectangular slot 32 formed substantially in the center thereof. When the second panel is folded alongside the first panel, the slots 31 and 32 are in aligned registry with one another. To facilitate folding of the second panel about the score lines 28, small cut-outs 33 may be made in or between the score lines, and to facilitate grasping of the second panel to fold it about the score lines, a cut-out 34 may be made in the flap adjacent the free edge of the panel.

The outer side edges of the major bottom flaps 19 and 20 are cut away or recessed at 35 for a purpose explained below. If desired, relief cuts 36 may be made in the outer side edges of the minor bottom flaps 21 and 22 to provide clearance space when the box is erected.

Figure 3:
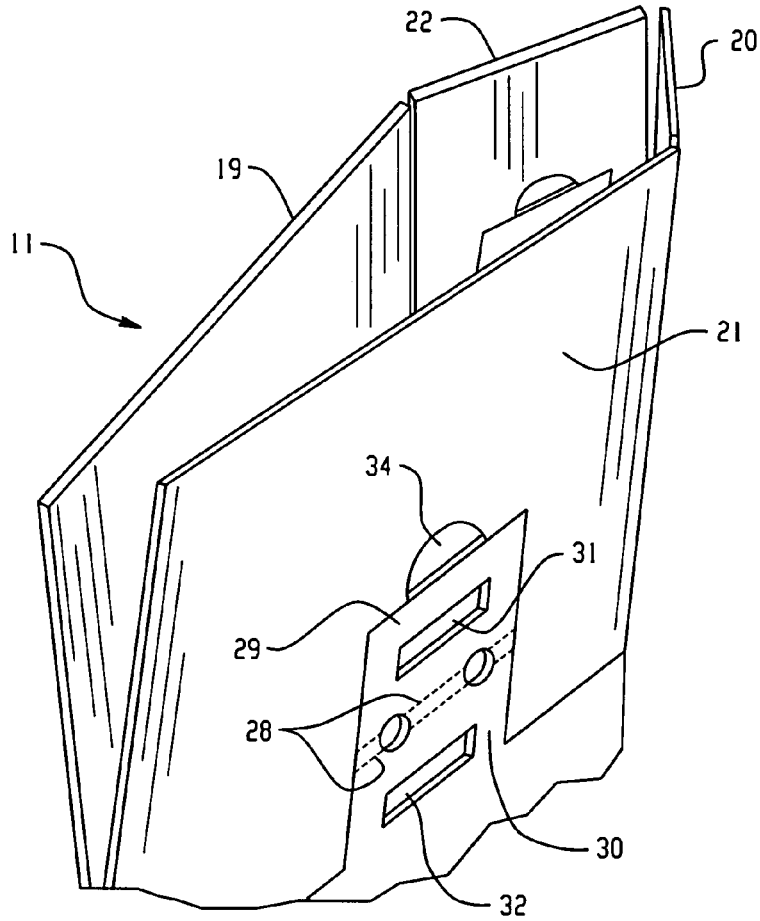
FIG. 3 is a fragmentary, enlarged perspective view of the box of the invention, shown in an inverted upside down orientation and partially expanded to an open position.
Figure 4:
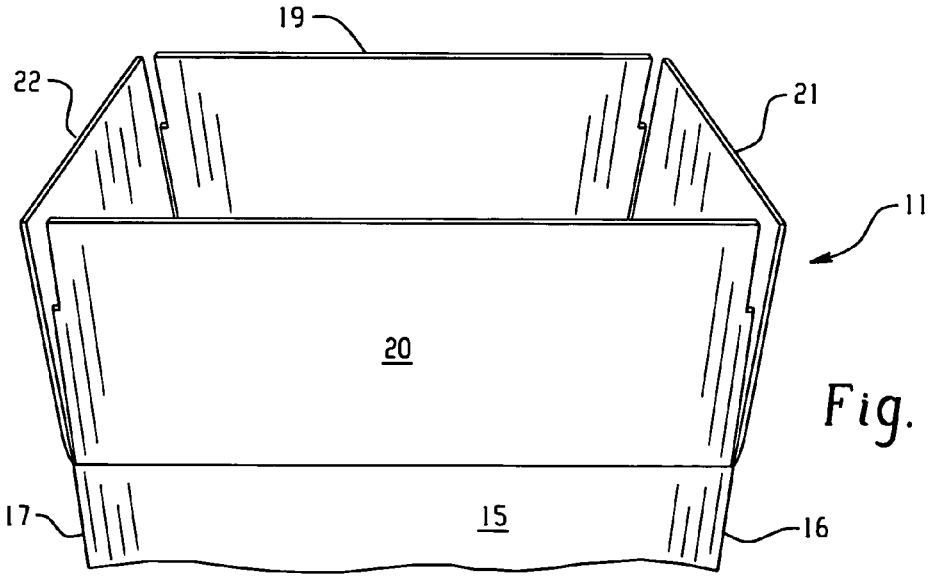
FIG. 4 is a bottom perspective view of the box of FIG. 3, with the box fully opened up from the flattened condition shown in FIG. 2 to an expanded condition.
Figure 5:
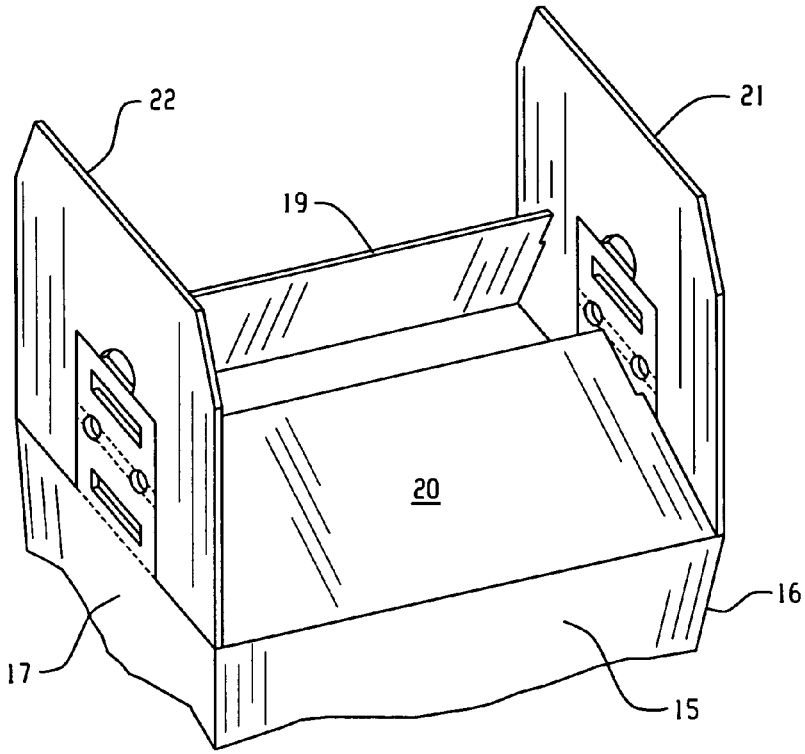
FIG. 5 is a fragmentary bottom perspective view of the box of FIG. 4, showing the two opposed major bottom flaps being folded inwardly over the bottom of the box.
Figure 6:
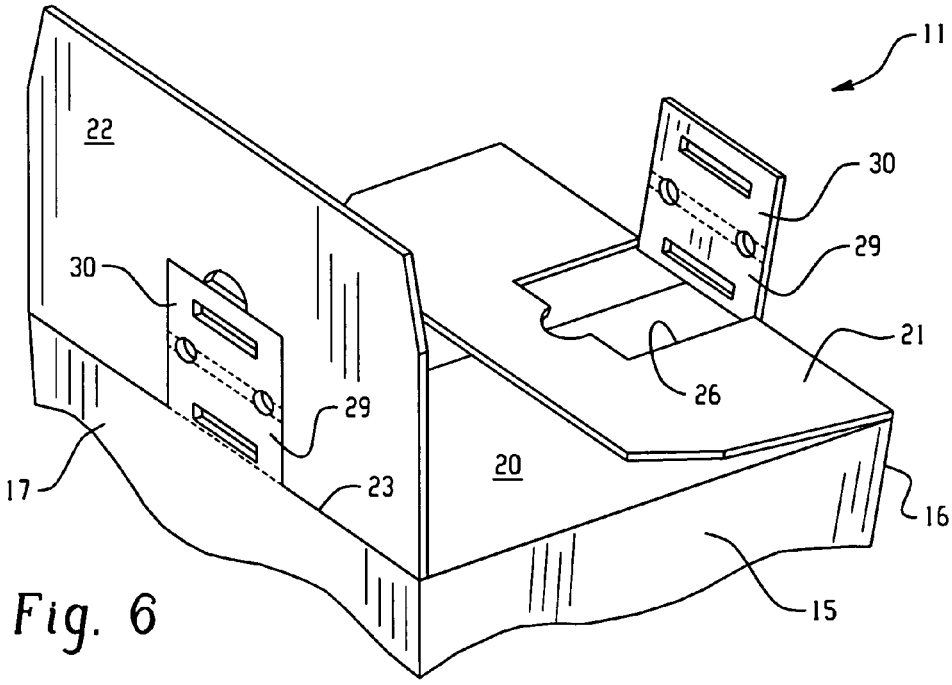
FIG. 6 is a fragmentary bottom perspective view of the box of FIG. 5, showing one of the two opposed minor bottom flaps folded inwardly over the previously folded major bottom flaps, leaving the panels that form the attaching tab in an upstanding position.
Figure 7:
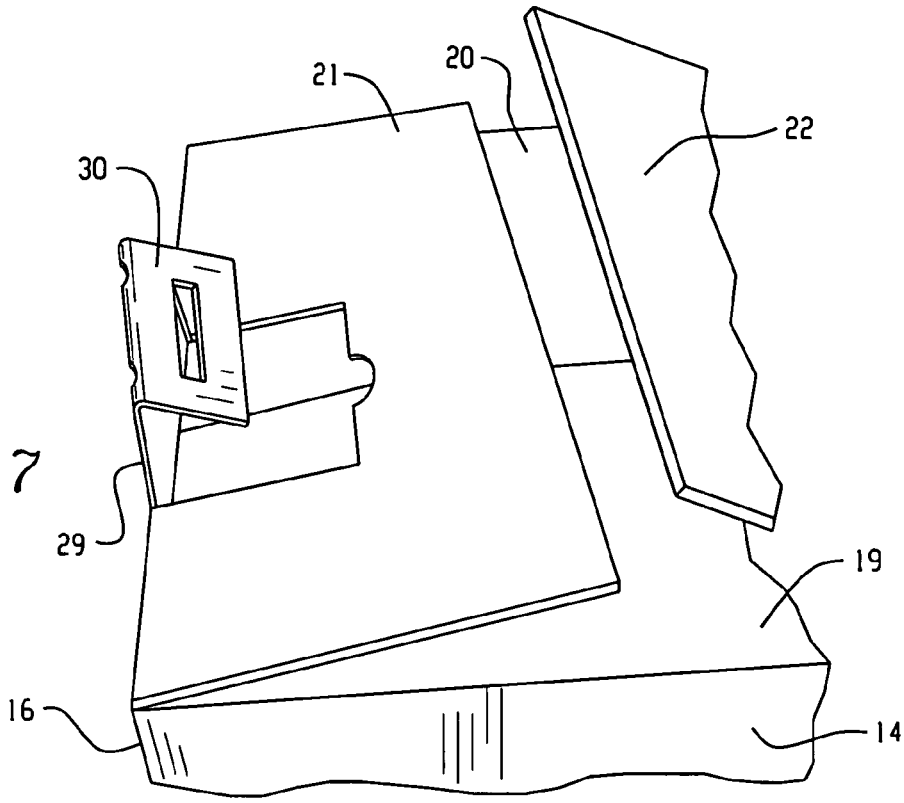
FIG. 7 is a fragmentary bottom perspective view of the box of FIG. 6, showing both minor flaps folded inwardly, and the second, inner panel of one of the attaching tabs being folded inwardly.
Figure 8:
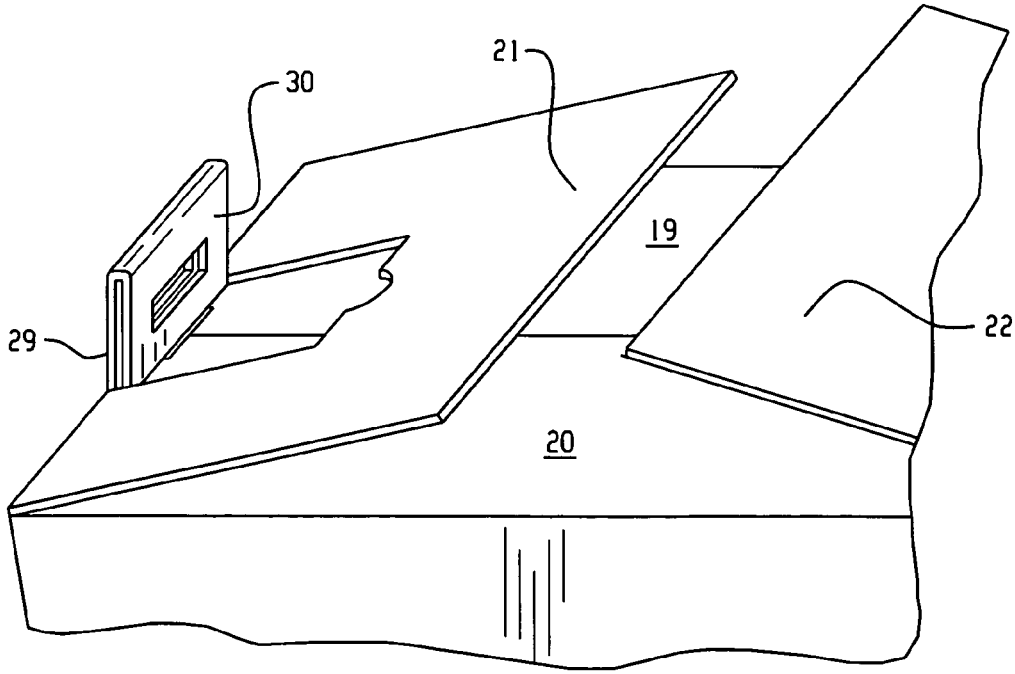
FIG. 8 is a fragmentary bottom perspective view of the box of FIG. 7, showing the second, inner panel of one of the attaching tabs being seated in its operative position, with the bottom free edge of the inner panel engaged in the space defined between the side edges of the major bottom flaps and the adjacent box side wall.
Figure 9:
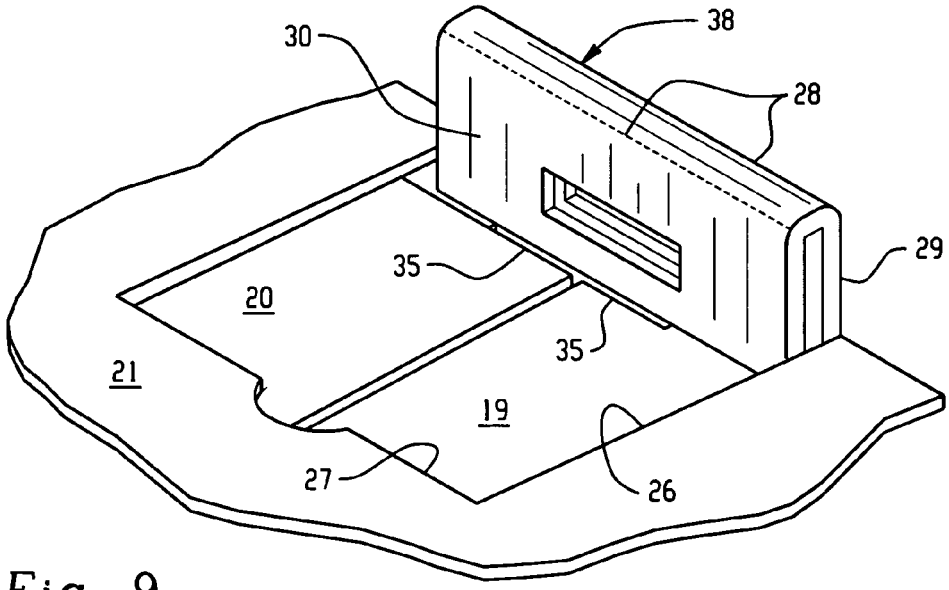
FIG. 9 is an enlarged fragmentary perspective view of the box of FIG. 8, showing one of the attaching tabs in its fully seated operative position.
Figure 10:
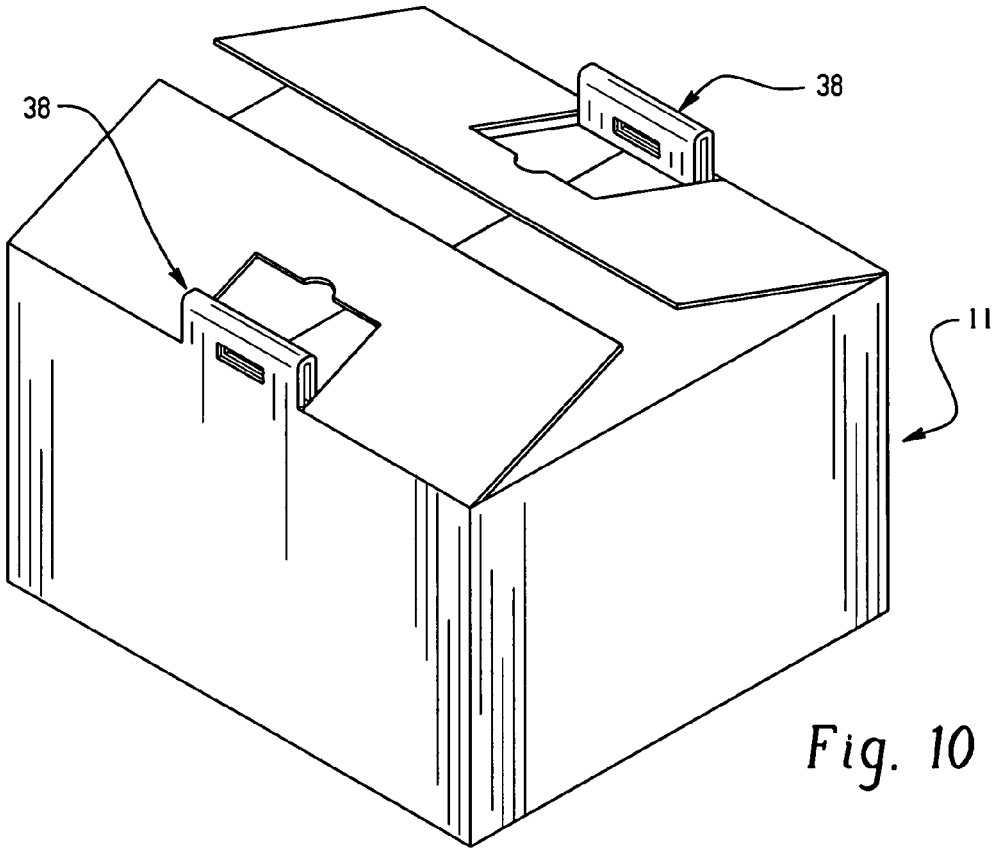
FIG. 10 is a bottom perspective view of a box according to the invention, shown with the bottom flaps all folded inwardly and both attaching tabs in their operative seated position.

Upon receipt by the end user of the assembly shown in FIG. 2, the flattened box 11 is placed in an upside down orientation, as shown in FIG. 3, and expanded to the open tubular configuration shown in FIG. 4. The major bottom flaps 19 and 20 are then folded inwardly and downwardly over the open bottom of the box, as shown in FIG. 5, followed by folding the minor bottom flaps 21 and 22 inwardly and downwardly over the previously folded major bottom flaps, as shown in FIG. 6. With further reference to FIG. 6, it will be noted that due to the rigid connection of the first panel 29 to the associated end wall, when the minor flaps are folded inwardly the panels 29 and 30 remain in an upright position generally coplanar with the end wall. To finish erecting the box, the second panels 30 are then folded inwardly and downwardly about the score lines 28, as shown in FIG. 7, and the free edge 36 of the second panel is pressed into the space provided between the associated end wall and adjacent edges of the inwardly folded major bottom flaps, as shown in FIGS. 8 and 9. This space is provided by the cuts 35 in the edges of the major bottom flaps, as described above. The completed erected box is shown in FIG. 10. The thus-folded panels form an attaching tab 38 for attaching the box to the pallet, as explained hereinafter.

Figure 11:
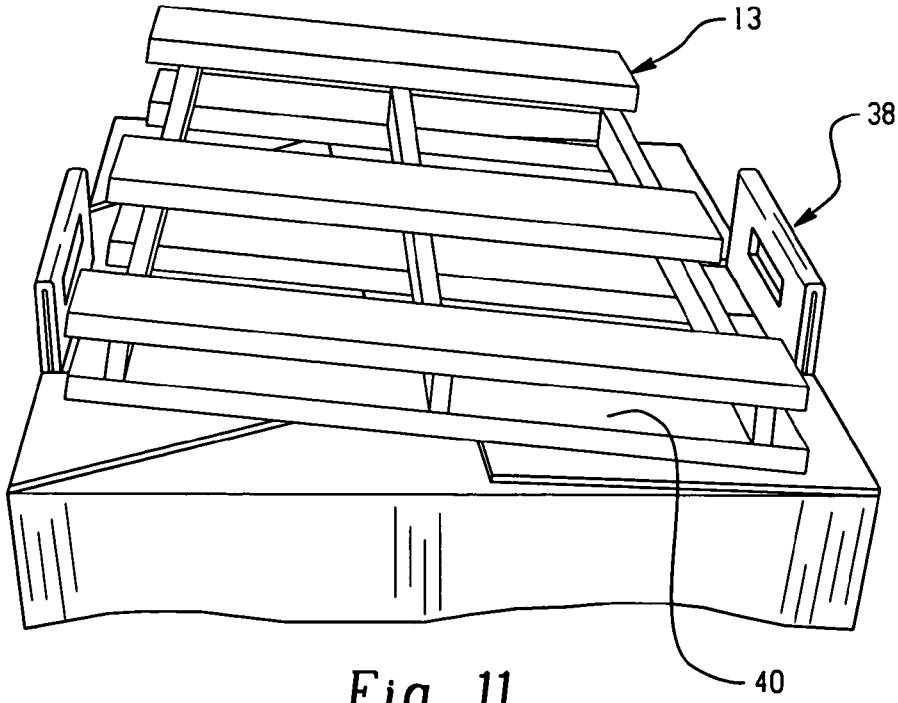
FIG. 11 is a fragmentary bottom perspective view of a first type of pallet being positioned on the bottom of the inverted box of FIG. 10.
Figure 12:
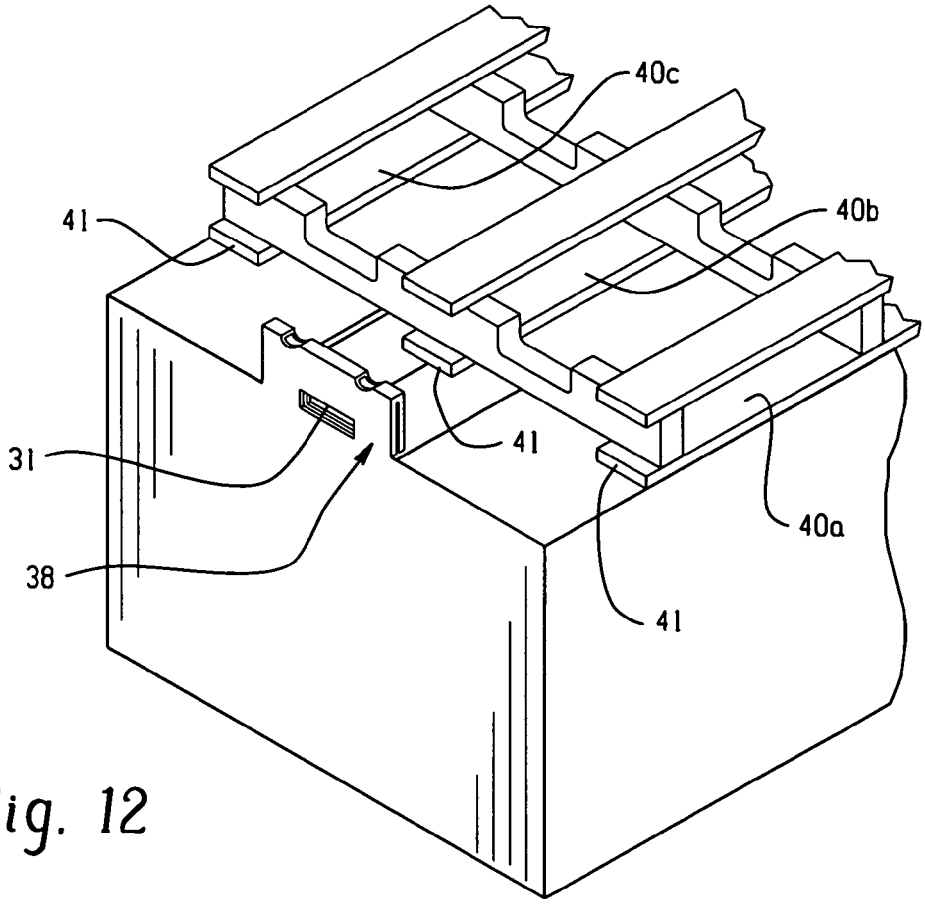
FIG. 12 is an enlarged fragmentary bottom perspective view of the pallet and box of FIG. 11, showing a first extended end of one of the pallet top deck slats aligned with the slots in the attaching tab, and depicting how the pallet holds the minor flaps in their inwardly folded position.
Figure 13:
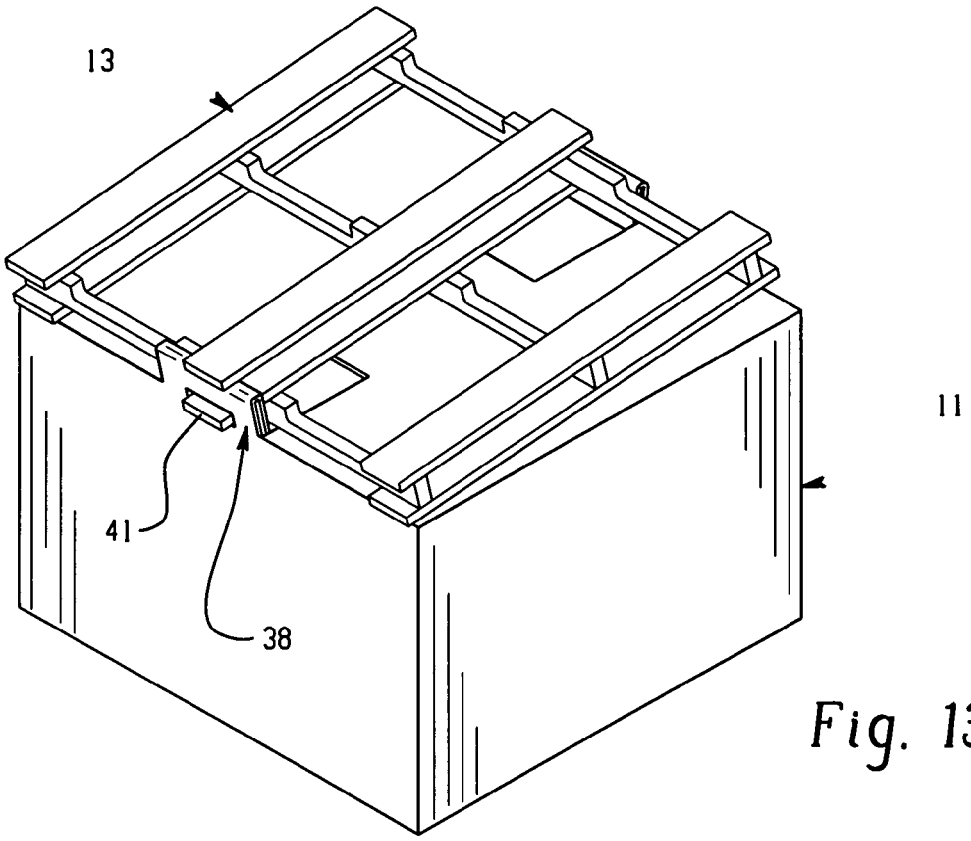
FIG. 13 is a bottom perspective view of the pallet and box of FIG. 12, showing the first extended end of the pallet slat fully engaged with a first one of the attaching tabs, and with the other end of the pallet in an elevated position preparatory to engaging the second extended end of the pallet slat with the second attaching tab.
Figure 14:
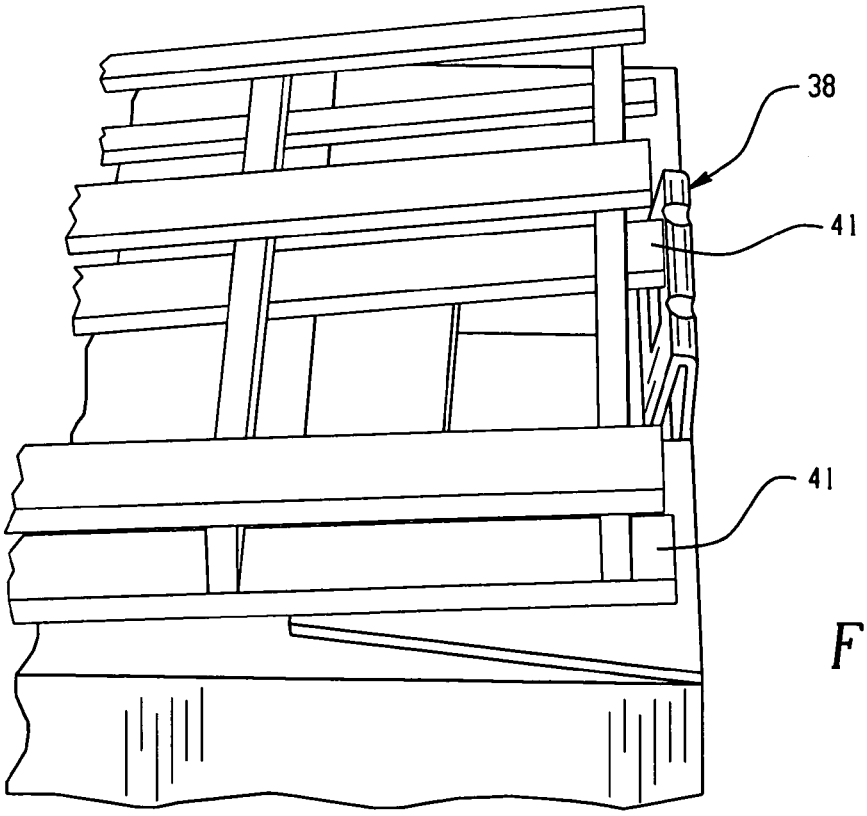
FIG. 14 is an enlarged, fragmentary bottom perspective view of the box and pallet of FIG. 13, showing how the second attaching tab is flexed outwardly to enable the adjacent end of the pallet to be moved down into operative position lying flat against the bottom of the box, whereby the second extended end of the pallet slat can be inserted into the slots of the second attaching tab.
Figure 15:
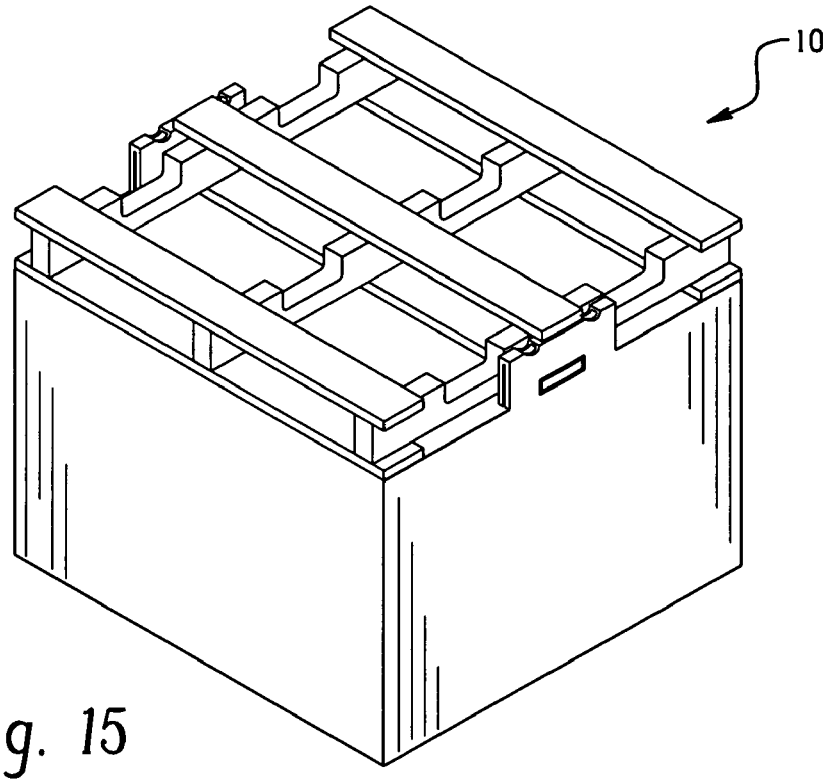
FIG. 15 is a bottom perspective view of a fully assembled box and pallet assembly according to the first embodiment of the invention.

The pallet 13 is then picked up, inverted to an upside down orientation, and placed over the bottom of the box, as shown in FIG. 11. As seen best in FIG. 12, the slats 40 that form the top deck of the pallet have extended ends 41. In the particular pallet shown, there are three slats 40*a*, 40*b* and 40*c* that form the top deck, and the center slat 40*b* is aligned with the slots 31 and 32 formed in the first and second panels 29 and 30, respectively, which comprise inner and outer panels in the erected attaching tab. The pallet is then pushed toward one of the attaching tabs, until the extended end 41 of the slat 40*b* is engaged in the slots 31 and 32, as shown in FIG. 13. The opposite attaching tab is then flexed outwardly, as shown in FIG. 14, so that the extended end of the slat 40*b* on the other end of the pallet can be inserted into the slots 31 and 32 of that tab, thus completing attachment of the pallet to the box, as shown in FIG. 15. The assembled box and pallet are then placed in an upright position, as shown in FIG. 16, for receiving product.

To detach the box from the pallet, the process described above is simply reversed. That is, the box and attached pallet are placed in an upside down position, the attaching tabs are flexed outwardly to disengage the extended slat ends from the slots, the attaching tabs are unfolded, and the flaps are unfolded so that the box can be flattened.

A second embodiment of the invention is indicated generally at 50 in FIGS. 18-22. The box 11' in this embodiment is made from a single unitary blank $B_2$ designed for use with a different pallet 13', and is essentially the same as the first embodiment, except that two side-by-side slots 51 and 52 are formed in the first panel 29', and two side-by-side slots 53 and 54 are formed in the second panel 30', rather than the single slots provided in the first embodiment. Further, the small cut-outs 33 and 34, provided in the first embodiment, are omitted from this embodiment. The attaching tabs 55 in this embodiment thus have two side-by-side slots for receiving the extended ends 56 of a pair of adjacent slats 57 and 58 in the pallet 13'. In all other respects this embodiment is the same as the first embodiment, and assembly and disassembly are achieved in the same way.

A third embodiment of the invention is indicated generally at 60 in FIGS. 23-27. The box 11" in this form of the invention is made from a single unitary blank $B_3$, and is essentially the same as embodiment two described above, except that the slots are omitted from the first, outer panel 29", whereby when the pallet is attached to the box, the outer surface of the attaching tab 61 is smooth and unbroken. In all other respects, this embodiment is the same as embodiment two, described above, and assembly and disassembly are achieved in the same way.

Figure 28:
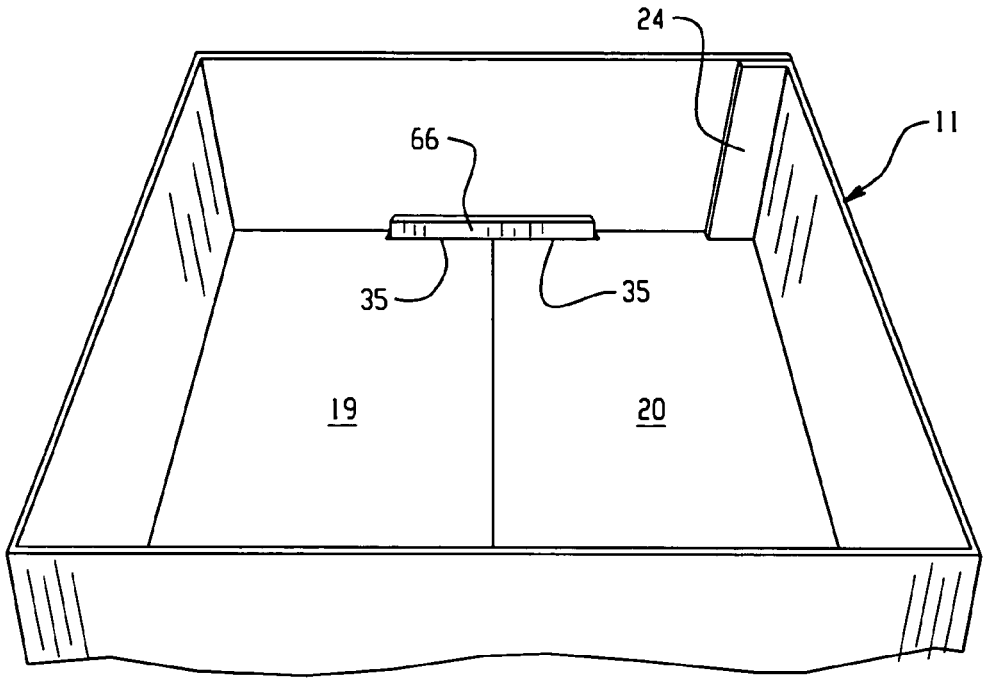
FIG. 28 is an enlarged fragmentary top perspective view of the box of FIG. 25.

FIG. 28 depicts the interior of a box 11, 11' or 11", and shows that the major bottom flaps 19 and 20 each extend half way across the bottom of the box so that the bottom is completely closed. The free edge 66 of the second, inner panel of the attaching tab is seen projecting up through the space defined by the cut-outs 35 in the adjacent side edges of the flaps 19 and 20. Except for the attaching tab and its associated structure, this inner box construction is generally the same as a conventional bulk box.

Figure 29:
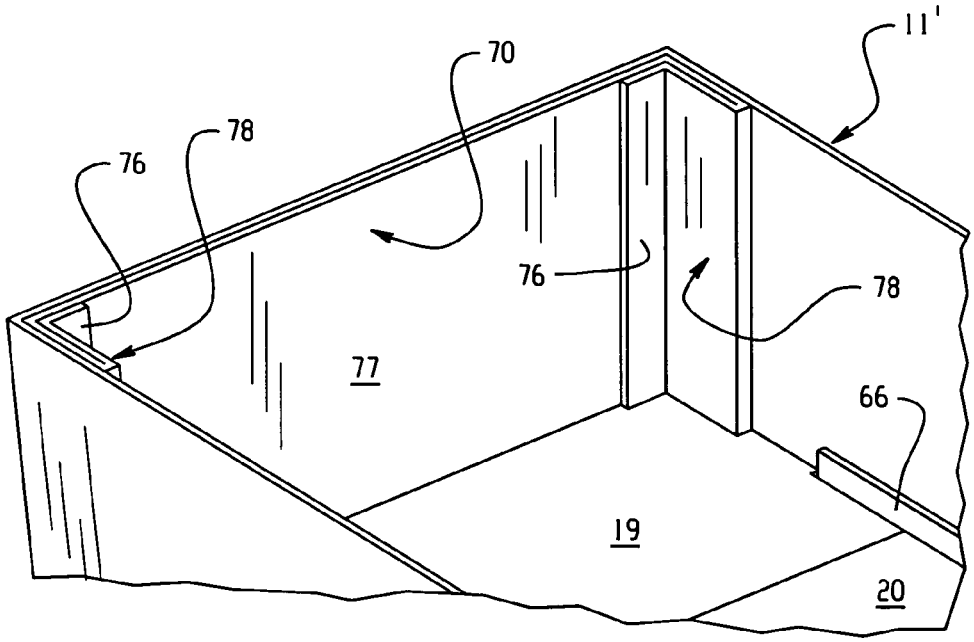
FIG. 29 is a further enlarged fragmentary top perspective view of the box of FIG. 28, showing a reinforcing insert according to the invention placed in one end (or side) of the box.
Figure 30:
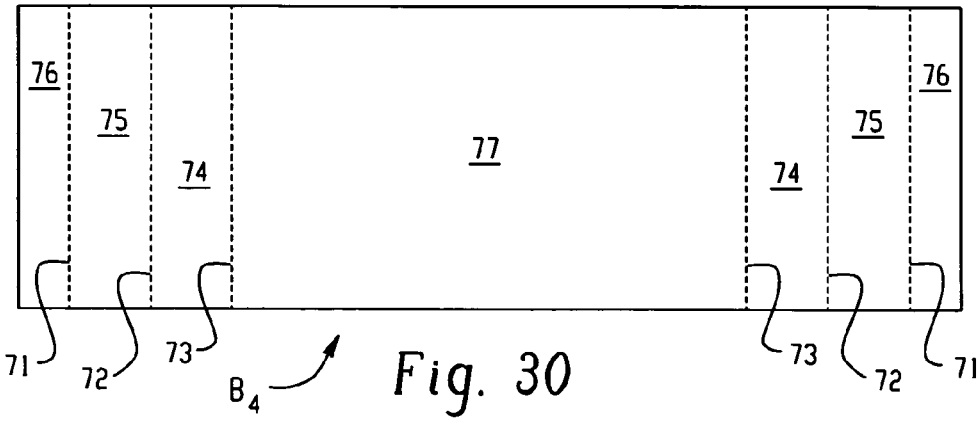
FIG. 30 is a plan view of a blank for making the insert of FIG. 29.
Figure 35:
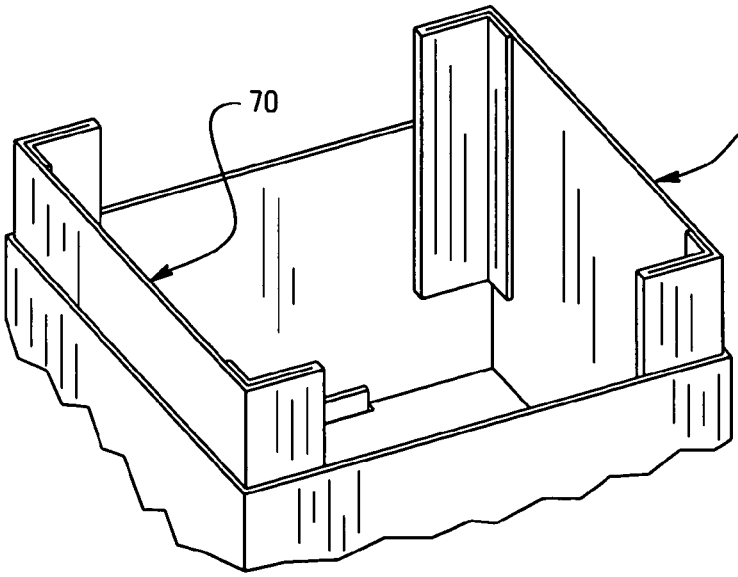
FIG. 35 is a fragmentary top perspective view of a pair of inserts partially inserted into opposite ends of a box.

FIG. 29 depicts a box 11, 11' or 11" having a reinforcing insert 70 placed therein in accordance with another aspect of the present invention. It should be noted that while only one end of the box, and one insert, are shown in this figure, an insert preferably would be placed in each of two opposite sides or ends of the box. See FIG. 35. Further, although the insert 70 is shown as placed in a box 11, 11' or 11" according to the invention, it could equally as well be used in other types of boxes.

The insert 70 is made from a single flat piece or blank $B_4$ of corrugated cardboard having a series of three scores or crease lines 71, 72 and 73 at each end, defining first, second and third panels 74, 75 and 76, respectively, at the ends of the blank, and a center panel 77.

Figure 31:
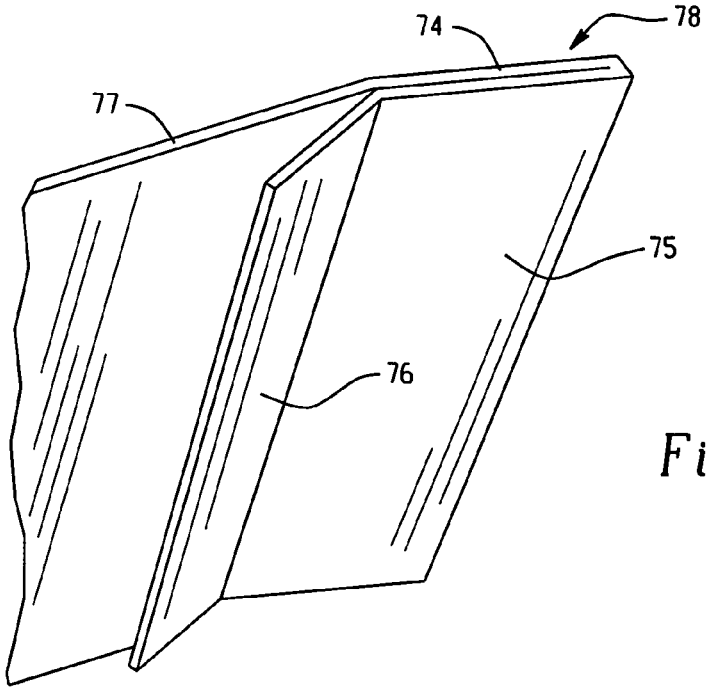
FIG. 31 is an enlarged fragmentary perspective view of one end of the reinforcing insert of FIG. 30.
Figure 32:
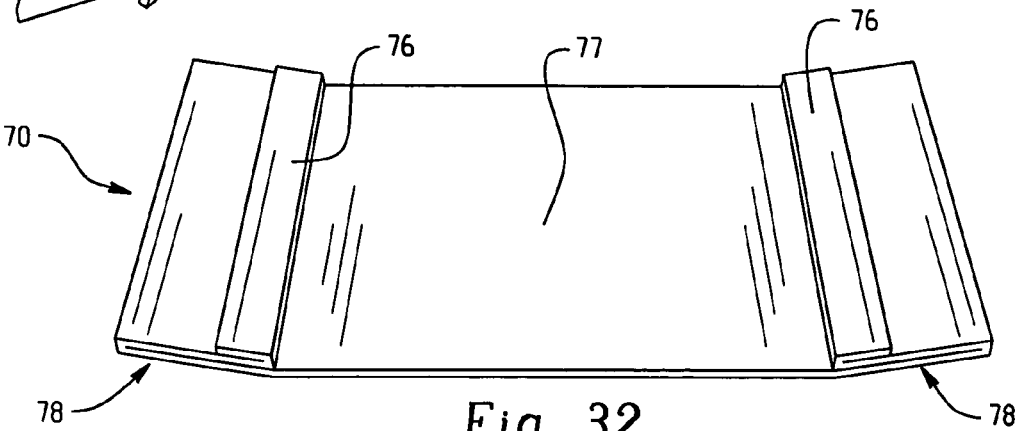
FIG. 32 is a top perspective view of the reinforcing insert of FIG. 29, prior to the insert being folded for insertion into the box.
Figure 33:
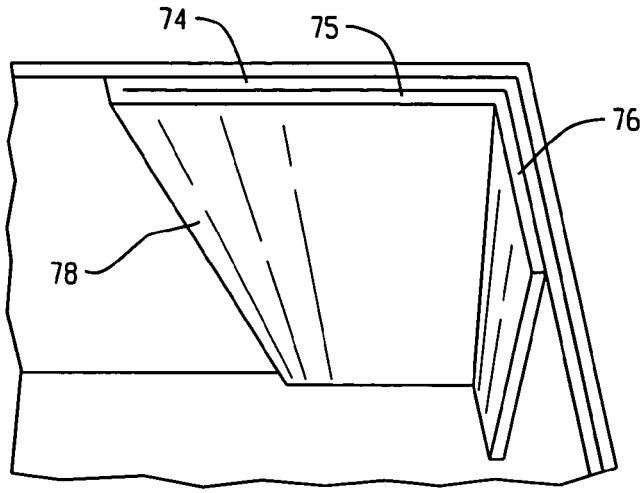
FIG. 33 is a greatly enlarged fragmentary top view of one corner of the box and insert of FIG. 29.
Figure 34:
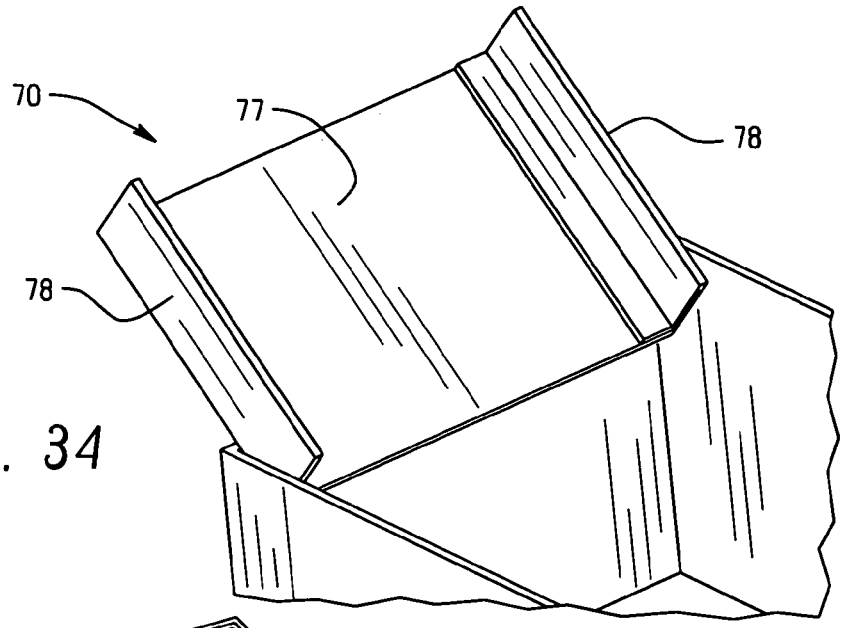
FIG. 34 is a fragmentary top perspective view of the insert of FIG. 31 being inserted into a box.

The distance between the scores or crease lines 73, and thus the width of the center panel 77, is approximately the same as the width of a box wall against which the insert is to be placed. A suitable adhesive is placed on the first and/or second panel, and the second panel 75 is folded onto the first panel 74 and adhesively laminated thereto, forming a double thickness hinged end or panel 78 on each end of the insert, and leaving the third panel 76 free, as depicted in FIG. 31. In use, the ends 78 are folded inwardly and an insert is pressed into place in each end or side of the box. The fit is snug to prevent displacement of the insert, and as seen best in FIG. 29, the height of the insert is the same as the height of the box.

Although the preferred embodiments illustrated and described herein pertain to rectangular boxes having four sides, it should be understood that the invention could be applied to other box configurations, such as octagonal.

Although particular embodiments of the invention are illustrated and described in detail herein, it is to be understood that various changes and modifications may be made to the invention without departing from the spirit and intent of the invention as defined by the scope of the appended claims.

What is claimed is:

1. A shipping container, comprising a pallet having a plurality of slats, each slat having a side and an end wherein said side is greater in length than said end, a perimeter of the pallet defined in part by the side of each outermost slat of said plurality of slats of said pallet, and a first end of a first of said slats that extends beyond the perimeter of the pallet; and a box having at least two opposing side walls, at least two opposing end walls, at least one flap is foldably joined along a fold line to a bottom edge of each side and end wall, said flaps forming a box bottom adapted to rest on said pallet, and at least one tab projecting downwardly from at least one of the side walls and comprising at least one slot therein so as to receive the extended end of the first slat in order to hold the box to the pallet.

2. The shipping container according to claim 1, wherein:

there are at least two tabs, located on respective opposite sides of said box.

3. The shipping container according to claim 1, wherein:

said box has two opposed side walls and two opposed end walls;

a flap is foldably joined along a fold line to a bottom edge of each side and end wall, said flaps forming said box bottom;

said fold line is interrupted over an area where two opposed flaps are foldably connected to an associated wall; and a series of cuts are made in said two opposed flaps, including two spaced apart cuts extending into said flaps from said fold line, and a third cut extending between the ends of said two cuts remote from said fold line, said interrupted area of said fold line extending between said two spaced apart cuts, said cuts and interrupted area defining said at least one tab, whereby the at least one tab extends integrally from an associated wall in coplanar relationship therewith.

4. The shipping container according to claim 3, wherein:

a fold extends between said two cuts, spaced from said third cut and from said interrupted area, and with said cuts defines a first and a second tab panels, said first tab panel being adjacent said interrupted area and said second tab panel being foldable about said fold to lie against said first tab panel; and said at least one slot is in said first tab panel.

5. The shipping container according to claim 4, wherein:

at least one slot is in each of said first and second tab panels.

6. The shipping container according to claim 5, wherein:

there are two slots in each of said tab panels.

7. The shipping container according to claim 6, wherein:

at least one reinforcing insert is in said box against at least one box wall to increase stacking strength of the box.

8. The shipping container according to claim 7, wherein:

a reinforcing insert is in each of two opposite ends of the box.

9. The shipping container according to claim 8, wherein:

the reinforcing insert is formed from a single unitary blank of corrugated cardboard, and comprises a center panel having a width and height approximately the same as the width and height of the box wall against which the insert is placed, and opposite end panels of double thickness foldably connected to opposite edges of the center panel and extending perpendicular to the center panel to lie against adjacent walls.

10. The shipping container according to claim 4, wherein:

said second attaching tab panel is devoid of slots.

11. The shipping container according to claim 1, wherein:

at least one reinforcing insert is in said box against at least one box wall to increase stacking strength of the box.

12. The shipping container according to claim 11, wherein:

a reinforcing insert is in each of two opposite ends of the box.

13. The shipping container according to claim 12, wherein:

the reinforcing insert is formed from a single unitary blank of corrugated cardboard, and comprises a center panel having a width and height approximately the same as the width and height of the box wall against which the insert is placed, and opposite end panels of double thickness foldably connected to opposite edges of the center panel and extending perpendicular to the center panel to lie against adjacent walls.

14. The shipping container according to claim 1, wherein the box bottom is completely closed.

15. The shipping container according to claim 1, wherein:

said box has two opposed side walls and two opposed end walls; and at least one flap is foldably joined along a fold line to a bottom edge of each side and end wall, said flaps forming said box bottom such that the flaps extend halfway across the bottom of the box and completely close the box bottom.

16. The shipping container according to claim 1, wherein said at least one tab comprises a plurality of tabs wherein each tab slot of the first slat and a second tab comprises at least one slot therein so as to receives the extended end of the a respective said slat in order to hold the box to the pallet.

* * * * *